US011148131B1

(12) United States Patent
Bulla

(10) Patent No.: US 11,148,131 B1
(45) Date of Patent: Oct. 19, 2021

(54) DROPPER

(71) Applicant: APC Packaging, LLC., Fort Lauderdale, FL (US)

(72) Inventor: Robert John Bulla, Coral Springs, FL (US)

(73) Assignee: APC Packaging, LLC., Fort Lauderdale, FL (US)

( * ) Notice: Subject to any disclaimer, the term of this patent is extended or adjusted under 35 U.S.C. 154(b) by 0 days.

(21) Appl. No.: 17/233,222

(22) Filed: Apr. 16, 2021

(51) Int. Cl.
*B01L 3/02* (2006.01)

(52) U.S. Cl.
CPC ..... *B01L 3/021* (2013.01); *B01L 2300/042* (2013.01); *B01L 2300/123* (2013.01); *B01L 2400/0481* (2013.01)

(58) Field of Classification Search
CPC ..... B01L 3/021; B01L 2300/123; B01L 2400/0481; B01L 2300/042
USPC ..... 422/520
See application file for complete search history.

(56) References Cited

U.S. PATENT DOCUMENTS 2,595,493 A * 5/1952 Slaby ..... B01L 3/021 73/864.11
3,276,847 A * 10/1966 Duff ..... B01L 3/0255 422/523
4,465,500 A 8/1984 Diamond et al.
5,307,847 A 5/1994 Pavenick et al.
7,157,510 B2 1/2007 Xie et al.
8,007,480 B2 8/2011 Kawashiro et al.
10,195,320 B2 2/2019 Fisher et al.
2007/0093765 A1* 4/2007 Kawashiro ..... B65D 47/18 604/295
2010/0301147 A1* 12/2010 Harkess ..... A61L 11/00 241/23
2012/0021151 A1 1/2012 Tatarka et al.
2012/0107799 A1 5/2012 Daum
2015/0119817 A1* 4/2015 Prasad ..... C08L 53/025 604/221
2016/0168345 A1* 6/2016 Eschenbacher ..... B32B 27/08 428/220
2017/0065454 A1 3/2017 Tedesco
2019/0161229 A1 5/2019 Mase
2020/0094244 A1* 3/2020 Ganter ..... B01L 3/0241

FOREIGN PATENT DOCUMENTS

WO 2014055676 4/2014

OTHER PUBLICATIONS

The Dow Chemical Company, "Infuse(TM) Olefin Block Copolymers, Product Selection Guide", Jun. 2015.

(Continued)

*Primary Examiner* — Matthew D Krcha
*Assistant Examiner* — Jacqueline Brazin
(74) *Attorney, Agent, or Firm* — Fleit Intellectual Property Law; Jon Gibbons

(57) ABSTRACT

A dropper includes a bulb, a pipette coupled to the bulb, and a cap coupled to the bulb. The dropper is composed entirely of recyclable material having a same recycle code. The dropper has a length of greater than 2 inches. The dropper is recyclable as a single unit. In one embodiment, the pipette includes an undercut on an inside of the pipette nearest the bulb.

20 Claims, 2 Drawing Sheets

(56) References Cited

OTHER PUBLICATIONS

Milliken & Company, "Milliken(R) Millad(R) NX(R) 8000, The New Standard In Clear Polypropylene", chemical.miliken.com, Aug. 19, 2020.
HCT Group, "PP Dropper", hctgroup.com, 2021.
"Compound Summary of 1,2,3-Trideoxy-4,6:5,7-bis-O-((4-propylphenyl)methylene)-nonitol", PubChem, Jul. 13, 2021, https://pubchem.ncbi.nlm.nih.gov/compound/58995446, National Institutes of Health, US.
Zsuzsanna Horvath et al., "The role of solubility and critical temperatures for the efficiency of sorbitol clarifiers in polypropylene", RSC Advances, May 6, 2014, pp. 19737-19745, The Royal Society of Chemistry, UK.

* cited by examiner

DROPPER

BACKGROUND

Field

This invention relates generally to droppers, and more specifically to a dropper that is recyclable.

Related Art

Droppers, also known as Pasteur pipettes, are well known. A dropper is a device used to measure liquids by drops. Droppers made in whole or in part of plastic are well known. Typically, a dropper consists of a bulb, a pipette and often a cap. Droppers having two or more of its components made of dissimilar materials are well known. Droppers having one or all of its components made of materials that are not recyclable are well known.

Droppers with a pipette made of regular polypropylene ($C_3H_6$) or standard clarified polypropylene are well known. A pipette made of regular polypropylene ($C_3H_6$) is disadvantageously opaque such that an amount of liquid, or bulk, in the pipette cannot be readily discerned. A pipette made of standard clarified polypropylene is disadvantageous because its hazy milky color can skew color palettes in the beauty industry, and it has a low quality appearance. Also, even if a pipette made of standard clarified polypropylene were separated from the rest of a dropper, the pipette would still not be recycled because the pipette would fail a 2 inch by 2 inch test promulgated by The Association of Plastic Recyclers. Some recyclers may require that recyclable plastic material have minimum dimensions different than 2 inches by 2 inches.

Droppers with a bulb made of a thermoplastic elastomer, silicone or nitrile are well known. Disadvantageously, a bulb made of a thermoplastic elastomer, silicone or nitrile is not recyclable.

Droppers made in whole or in part of glass are well known. Droppers with a pipette made of glass are well known. Disadvantageously, a pipette made of glass can break or shatter easily. Disadvantageously, in many cases, a pipette made of glass is not recyclable because vial glass, also known as borosilicate glass, is not recycled and is it not easily discernible from flint glass. Borosilicate glass and flint glass will mix but the amount of heat required goes up significantly causing many issues when converting. A pipette made of glass must be shorter than a pipette made of plastic due to tolerances of glass cutting and forming. A pipette made of glass can shatter inside a bottle if the pipette were only slightly too long. Glass is fragile even when it is not in a bottle. Even if a pipette made of glass were separated from the rest of the dropper in an attempt to recycle the rest of the dropper, in most cases the rest of the dropper would still not be recycled because the bulb would fail the 2 inch by 2 inch test.

Droppers having some of their parts made of recyclable materials and some of their parts made of non-recyclable materials are well known. With such droppers, although it may be possible to separate the parts made of recyclable materials from the parts made of non-recyclable materials, the resulting parts (made of recyclable materials) would be too small to be recycled. This is because the recycling industry requires that at least one dimension of recyclable plastic material be at least 2 inches, and the largest dimension of individual parts of most droppers for the beauty, or cosmetic, industry is less than 2 inches.

One known dropper is made entirely of polypropylene. However, this known dropper disadvantageously has a bulb that is very stiff and is hard to squeeze. Moreover, this known dropper disadvantageously has a pipette that is very cloudy and hazy.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Figure 1:
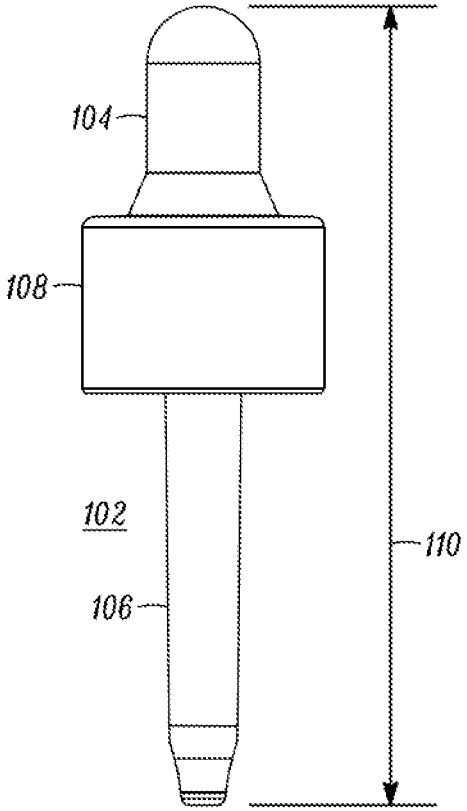
FIG. 1 is a front view of a dropper, including a pipette, in accordance with the invention.

FIG. 1 is a front view of a dropper 102 in accordance with the invention. The dropper 102 comprises a bulb 104, a pipette 106 coupled to the bulb, and a cap 108 coupled to the bulb. Although a size of the bulb 104, the pipette 106 and the cap 108 may be less than 2 inches individually, the dropper 102 advantageously has a length 110 of at least 2 inches. Therefore, the dropper 102 is recyclable. The dropper 102 is recyclable as a unit, i.e., the dropper can be recycled without first being disassembled. In one embodiment, the cap 108 attaches to a bottle (not shown) in a manner well known. The bottle may hold a liquid, or bulk, that can be pulled into the pipette 106 and dispensed from the pipette through use of the dropper 102 in a manner well known.

In one embodiment, the bulb 104 is made of polyolefins with alternating blocks of hard and soft segments manufactured by The Dow Chemical Company of Midland, Mich. and marketed under the tradename INFUSE™ olefin block copolymer by The Dow Chemical Company. Advantageously, this material has good creep resistance, has better compression set properties than polypropylene, and is recyclable. In one embodiment, the bulb 104 is made of INFUSE™ olefin block copolymer grade 9507. Other olefins, used with known droppers, have varying degrees of flexibility but fail with compression set and creep of the dimensions. The bulb 104 has a resin identification code, i.e., a recycle code, of "5".

In some embodiments, the material of the bulb 104 may include less than 1% of a thermoplastic elastomer. The thermoplastic elastomer improves impact properties of polypropylene. When material includes less than 1% of a thermoplastic elastomer, such material retains its recycle code, of "5".

In one embodiment, the pipette 106 is made of standard clarified polypropylene with a clarifying agent 1,2,3-trideoxy-4,6:5,7-bis-O-((4-propylphenyl)methylene)-nonitol manufactured by Milliken & Company of Spartanburg, S.C. and marketed under the tradename NX® UltraClear™. The clarifying agent 1,2,3-trideoxy-4,6:5,7-bis-O-((4-propylphenyl)methylene)-nonitol is marketed under the tradename Millad® NX® 8000 by Milliken & Company. NX® Ultra- Clear™ brand polypropylene is a master batch that can be let down at a specified ratio or can be purchased as a polypropylene with Millad® NX® 8000 brand clarifying agent integrated into the polymer to eliminate a need for weighing and mixing every batch. Advantageously, a pipette made of NX® UltraClear™ brand polypropylene is as clear as polyethylene terephthalate, reduces the hazy white effect of standard clarified polypropylene by up to 60% and is recyclable. Advantageously, the pipette 106 does not break or shatter as easily as a glass pipette. Unlike a pipette made of glass, the pipette 106 would bend, not break. The pipette 106 has a recycle code of "5". An amount of liquid, or bulk, in the pipette 106 can be readily discerned.

In one embodiment, the cap 108 is made of polypropylene. The cap 106 has a recycle code of "5". In one embodiment, the cap 108 is made from polypropylene which can be made at varying levels of post-consumer recycled polypropylene. In one embodiment, the cap 108 is made of an injection grade polypropylene. Advantageously, the recycle code of the cap 108 is the same as the recycling code of the bulb and the pipette.

A purpose of the dropper 102 is to increase sustainability of packages in the cosmetic industry. Advantageously, the material of the bulb 104, the material of the pipette 106 and the material of the cap 108 give the proper protection for beauty industry chemicals that are used, such as retinol, volatile silicones and sun protection factor (SPF) chemicals. Other thermoplastic elastomers such as styrene block copolymers that are used with known droppers do not hold up to retinol, volatile silicones and SPF chemicals.

Figure 2:
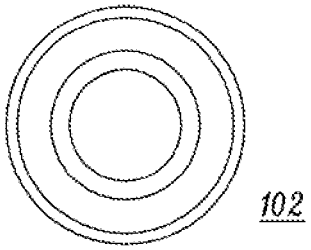
FIG. 2 is a top view of the dropper shown in FIG. 1.

FIG. 2 is a top view of the dropper 102.

Figure 3:
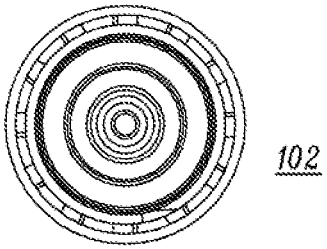
FIG. 3 is a bottom view of the dropper shown in FIG. 1.

FIG. 3 is a bottom view of the dropper 102.

Figure 4:
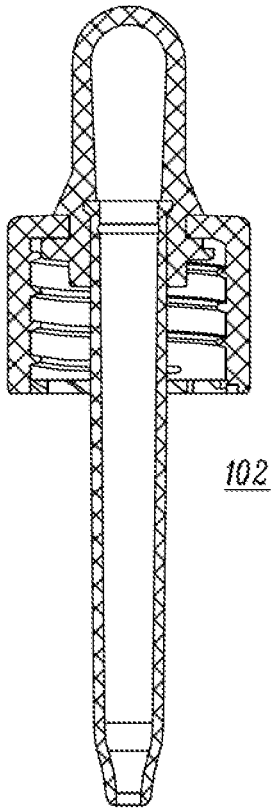
FIG. 4 is a cross-sectional view of the dropper shown in FIG. 1.

FIG. 4 is a cross-sectional view of the dropper 102.

In one embodiment, the length 110 of the dropper 102 is greater than 3 inches, and with the largest dimension of the bulb 104, the pipette 106 and the cap 108 less than 2 inches individually. However, the fact that the largest dimension of each of the bulb 104, the pipette 106 and the cap 108 is less than 2 inches individually is not critical because, in accordance with the invention, the dropper 102 is recyclable as a single unit, i.e., without being disassembled into its parts.

In another embodiment, the length 110 of the dropper 102 is 2.89 inches, which is 73.58 mm. In such embodiment, the largest dimension of the bulb 104 is 25.75 mm, the largest dimension of the pipette 106 is 25.75 mm, and the largest dimension of the cap 108 is 22.30 mm. However, in such embodiment, the dimensions of the bulb 104, the pipette 106 and the cap 108 are not critical because, in accordance with the invention, the dropper 102 is recyclable as a single unit, i.e., without being disassembled into its parts.

Figure 5:
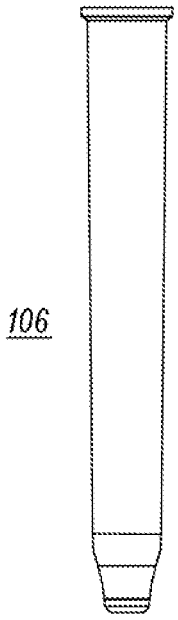
FIG. 5 is a front view of the pipette in accordance with the invention.

FIG. 5 is a front view of the pipette 106.

Figure 6:
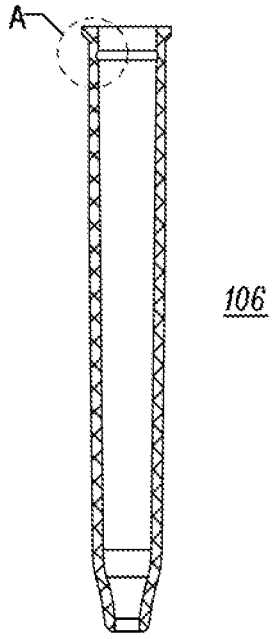
FIG. 6 is a cross-sectional view of the pipette shown in FIG. 5.

FIG. 6 is a cross-sectional view of the pipette 106.

Figure 7:
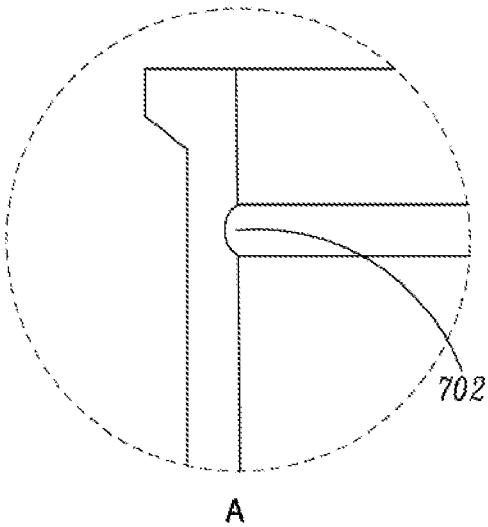
FIG. 7 is an enlargement of area "A" shown in FIG. 6.

FIG. 7 is an enlargement of area "A" shown in FIG. 6, including an undercut 702 on an inside of the pipette 106 nearest the bulb 104 when assembled. Because the pipette 106 is for the beauty industry and clarity is important, in addition to using NX® UltraClear™ polypropylene, a cavity and core of a steel mold of a plastic injection molding tool is polished to an A1 level, or a mirror, polish. This enhances the clarity of the resin after molding, but creates a problem of ejecting the pipette 106 out of the cavity when the mold opens. Both halves of the mold have one of the highest levels of polishing which causes the pipette 106 to slip off the core and stay in the mold when the mold opens and two halves of the mold separate.

Advantageously, the undercut 702 holds the pipette 106 on the core but still allows the pipette to be ejected cleanly. With plastic injection molding, the undercut 702 must be done correctly or else, when the pipette 106 is ejected from the mold, the mold will tear the undercut or smear the pipette.

In one embodiment, the dropper 102 is an eye dropper.

The terms "a" or "an", as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an". The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements.

The Detailed Description section, and not the Abstract section, is intended to be used to interpret the claims. The Abstract section may set forth one or more but not all embodiments of the invention, and the Abstract section is not intended to limit the invention or the claims in any way.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages or solutions to problems that are described herein with regard to specific embodiments are not intended to be construed as a critical, required, or essential feature or element of any or all the claims.

I claim:

1. A dropper, comprising:

a bulb made of polyolefins with alternating blocks of hard and soft segments;

a pipette coupled to the bulb; and a cap coupled to the bulb, wherein the dropper is composed entirely of recyclable materials each of which complies with specifications of a same recycle code.

2. The dropper of claim 1, wherein the pipette is made of polypropylene with 1,2,3-trideoxy-4,6:5,7-bis-O-((4-propylphenyl)methylene)-nonitol.

3. The dropper of claim 2, wherein the cap is made of polypropylene.

4. The dropper of claim 1, wherein the recycle code is "5".

5. The dropper of claim 1, wherein the pipette includes an undercut on an inside of the pipette nearest the bulb.

6. The dropper of claim 1, wherein a length of the dropper is greater than 2 inches.

7. The dropper of claim 6, wherein the dropper is recyclable as a single unit.

8. A dropper, comprising:

a bulb;

a pipette made of polypropylene with 1,2,3-trideoxy-4,6:5,7-bis-O-((4-propylphenyl)methylene)-nonitol, the pipette coupled to the bulb; and a cap coupled to the bulb, wherein the bulb, the pipette and the cap are each composed entirely of recyclable material that complies with specifications of a same recycle code.

9. The dropper of claim 8, wherein the bulb is made of polyolefins with alternating blocks of hard and soft segments.

10. The dropper of claim 9, wherein the cap is made of polypropylene.

11. The dropper of claim 8, wherein the recycle code is "5".

12. The dropper of claim 8, wherein the pipette includes an undercut on an inside of the pipette nearest the bulb.

13. The dropper of claim 8, wherein a length of the dropper is greater than 2 inches.

14. The dropper of claim 8, wherein the dropper is recyclable as a single unit.

15. A dropper, comprising:

a bulb composed entirely of recyclable material that complies with recycle code of "5" specifications;

a pipette composed entirely of recyclable material that complies with recycle code of "5" specifications, the pipette coupled to the bulb; and a cap composed entirely of recyclable material that complies with recycle code of "5" specifications, the cap coupled to the bulb.

16. The dropper of claim 15, wherein the bulb is made of polyolefins with alternating blocks of hard and soft segments.

17. The dropper of claim 15, wherein the pipette is made of polypropylene with 1,2,3-trideoxy-4,6:5,7-bis-O-((4-propylphenyl)methylene)-nonitol.

18. The dropper of claim 15, wherein the cap is made of polypropylene.

19. The dropper of claim 15, wherein the dropper is recyclable as a single unit.

20. The dropper of claim 15, wherein the dropper consists of:

a bulb composed entirely of recyclable material that complies with recycle code of "5" specifications;

a pipette composed entirely of recyclable material that complies with recycle code of "5" specifications, the pipette coupled to the bulb; and a cap composed entirely of recyclable material that complies with recycle code of "5" specifications, the cap coupled to the bulb.

* * * * *